US005331252A

United States Patent [19]

Kim

[11] Patent Number: 5,331,252

[45] Date of Patent: Jul. 19, 1994

[54] STRUCTURE AND DRIVING METHOD OF A PLASMA DISPLAY PANEL

[75] Inventor: Dae-Il Kim, Kyungki-Do, Rep. of Korea

[73] Assignee: Samsung Electron Devices Co., Ltd., Kyungki-do, Rep. of Korea

[21] Appl. No.: 975,703

[22] Filed: Nov. 13, 1992

[30] Foreign Application Priority Data

Mar. 4, 1992 [KR] Rep. of Korea ..... 92-3566

[51] Int. Cl.[5] ..... G09G 3/10

[52] U.S. Cl. ..... 315/169.4; 315/168; 313/584

[58] Field of Search ..... 315/169.4, 169.3, 169.2, 315/169.1, 168; 313/584, 585, 582, 590

[56] References Cited

U.S. PATENT DOCUMENTS

| | | | |
|---|---|---|---|
| 4,665,345 | 5/1987 | Shionoya et al. | 315/169.4 |
| 4,754,203 | 6/1988 | Murakami | 315/169.4 |
| 4,999,541 | 3/1991 | Kim et al. | 313/584 |
| 5,210,469 | 5/1993 | Kim | 315/169.4 |

*Primary Examiner*—Robert J. Pascal
*Assistant Examiner*—Haissa Philogene
*Attorney, Agent, or Firm*—Leydig, Voit & Mayer

[57] ABSTRACT

A plasma display panel includes anodes and barrier ribs formed on an upper face plate, first sustaining electrodes which are formed on a lower rear plate, and covered with a dielectric material, and cathodes which are formed on the dielectric material and connected to the respective capacitors via a common node, thereby serving as second sustaining electrodes. In a driving method of the panel, the first sustaining electrode is supplied with a pulse varying from ground potential to a first positive potential, from the first positive potential back to ground potential, and then from ground potential to a first negative potential, the second sustaining electrode is supplied with a pulse varying from ground potential to the first negative potential, from the first negative potential back to ground potential, and then from ground potential to the first positive potential, the anode is supplied with a writing pulse varying from a third positive potential to a fourth positive potential for data writing, when the pulses of the first and second sustaining electrodes are both at ground potential and the cathode is supplied with a negative scanning pulse varying from a third negative potential to a fourth negative potential, and the cathode is supplied with a negative erasing pulse having an amplitude equal to the difference between the third and fourth potentials, for erasing the written data after a predetermined time has elapsed. Thus, stable memory operation becomes possible.

9 Claims, 2 Drawing Sheets

STRUCTURE AND DRIVING METHOD OF A PLASMA DISPLAY PANEL

BACKGROUND OF THE INVENTION

The present invention relates to a plasma display panel, and more particularly to a structure and driving method of a plasma display panel.

A conventional "DC pulse memory plasma display panel" of the NHK Broadcasting Technique Institute adopts a system wherein sustaining pulses are applied from external anodes using the "space charge" within a panel as a memory means. However, practically, the supply of high frequency sustaining pulses to each anode is severely restricted in practice, which also frequently causes malfunction. Also, the use of space charge as memory means is difficult.

Moreover, in a "trigger plasma display panel" which is considered similar to the structure of that of the present invention, the pulse externally supplied to perform a memory operation is identical to that of NHK, and space charge is also used since the sustaining discharge occurs between anodes and cathodes in DC types. Thus, this panel is unsuitable for memory operations.

SUMMARY OF THE INVENTION

It is an object of the present invention to provide a structure and driving method of a plasma display panel, wherein electrodes for supplying sustaining pulses are separately provided, thereby preventing malfunction.

It is another object of the present invention to provide a driving method of a plasma display panel which can easily perform a memory operation using wall charge.

To achieve the above objects of the present invention, there is provided a plasma display panel comprising: stripe-like anodes and barrier ribs formed on an upper face plate; first sustaining electrodes formed over the whole inner surface of a lower rear plate, and covered with a dielectric material; and stripe-like cathodes formed on the dielectric material layer and connected to the respective capacitors via a common node, thereby serving as second sustaining electrodes.

The driving method of the above plasma display panel according to the present invention is such that the first sustaining electrode is supplied with a pulse varying from ground potential to a first positive potential, from the first positive potential back to ground potential, and then from ground potential to a first negative potential;

the second sustaining electrode is supplied with a pulse varying from ground potential to the first negative potential, from the first negative potential back to ground potential, and then from ground potential to the first positive potential;

the anode is supplied with a writing pulse varying from a third positive potential to a fourth positive potential for data writing, when the pulses of the first and second sustaining electrodes are both at ground potential and the cathode is supplied with a negative scanning pulse varying from a third negative potential to a fourth negative potential; and the cathode is supplied with a negative erasing pulse having an amplitude equal to the difference between the third and fourth potentials, for erasing the written data after a predetermined time has elapsed.

Otherwise, the driving method of the above plasma display panel according to the present invention is such that the first sustaining electrode is supplied with a pulse varying from ground potential to a first positive potential, then from the first positive potential to ground potential;

the second sustaining electrode is supplied with a pulse varying from ground potential to the first positive potential, then from the first positive potential to ground potential;

the anode is supplied with a writing pulse varying from a fourth positive potential to a fifth positive potential for data writing, when the pulses of the first and second sustaining electrodes are both at ground potential and the cathode is supplied with a negative scanning pulse varying from a third positive potential to a third negative potential; and the cathode is supplied with a negative erasing pulse having an amplitude equal to the difference between the third and fourth positive potentials for erasing the written data after a predetermined time has elapsed.

BRIEF DESCRIPTION OF THE DRAWINGS

The above objects and other advantages of the present invention will become more apparent by the following description with reference to accompanying drawings, in which.

DETAILED DESCRIPTION OF THE INVENTION

Figure 1:
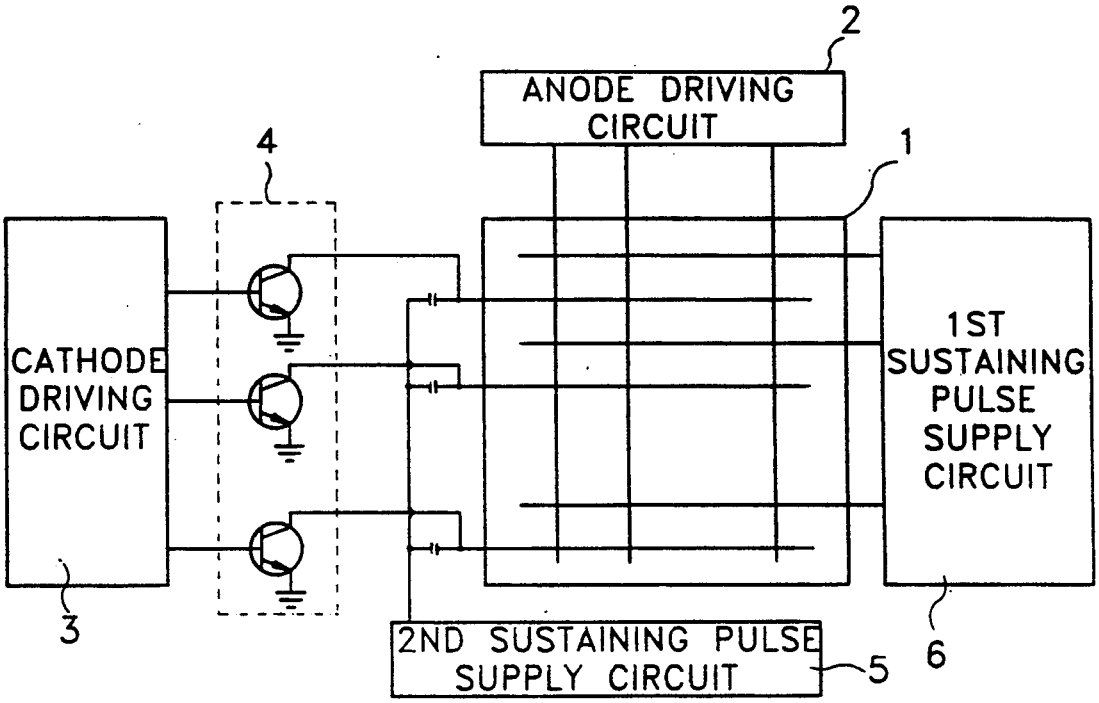
FIG. 1 shows a driving circuit for driving a plasma display panel according to the present invention.

FIG. 1 schematically illustrates the operation of a driving circuit of a plasma display panel according to the present invention. The driving circuit includes: a plasma display panel I which has anodes and cathodes arranged so as to intersect each other, and sustaining electrodes arranged parallel with the cathodes; an anode driving circuit 2 for supplying data to the anodes of plasma display panel 1; a cathode driving circuit 3 for scanning the cathodes of plasma display panel 1; switching transistors 4 each having its base connected to the output of cathode driving circuit 3, its emitter grounded, and its collector connected to respective cathodes; a second sustaining pulse supply circuit 5 for supplying a second sustaining pulse through each capacitor formed on respective cathodes; and a first sustaining pulse supply circuit 6 for supplying a first sustaining pulse to the sustaining electrodes. That is, according to the structure of the present invention, the cathodes are supplied with the output signals from cathode driving circuit 3 while scanning, and with signals from second sustaining pulse supply circuit 5 via the capacitors while sustaining operation. A first sustaining pulse from first sustaining pulse supply circuit 6 is supplied to the stripe-like sustaining electrodes arranged in parallel to the cathodes. Accordingly, the cathodes of the present invention serve as scanning cathodes or as sustaining electrodes which receive the sustaining pulse from the second sustaining pulse supply circuit 5. Any kind of sustaining electrodes for sustaining discharge, such as striped electrodes formed on the anode or cathode plane, can be adopted to the plasma display panel of the present invention, provided that individual capacitors and common terminal exist under the cathodes. In other words, in the present invention, the sustaining pulses are not supplied through the anodes, but sustaining electrodes are separately formed, and sustaining electrodes are realized by having individual capacitors with a common terminal under the scanning electrodes.

Figure 2:
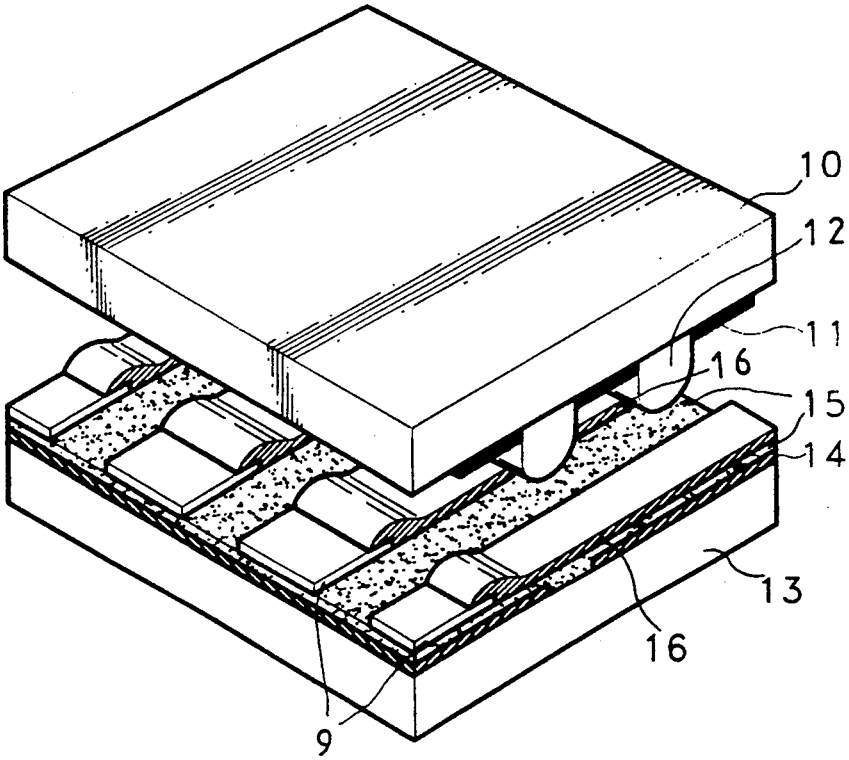
FIG. 2 shows a structure of the plasma display panel according to the present invention.

FIG. 2 illustrates the structure of the plasma display panel according to the present invention.

In the electrode structure shown in FIG. 2, anodes 11 are formed on upper glass face plate 10 alternatively disposed between barrier ribs 12. Sustaining electrodes 14 are formed on a lower glass rear plate 13 and are preferably completely covered by a dielectric material 15. Cathodes 16 are preferably disposed on the dielectric material 15 to partly cover the sustaining electrodes 14. Here, the sustaining electrodes 14 are covered with a dielectric material 15 so as not to be exposed to a gas disposed between the upper glass face plate 10 and the lower glass rear plate 13. Since the dielectric material completely covers the sustaining electrodes 14, both a space charge and a wall charge are simultaneously utilized to sustain the discharge. The cathodes 16 serving as other sustaining electrodes are directly exposed to the gas. The reference numeral 9 denotes a terminal through which electric power is supplied.

Figure 3A:
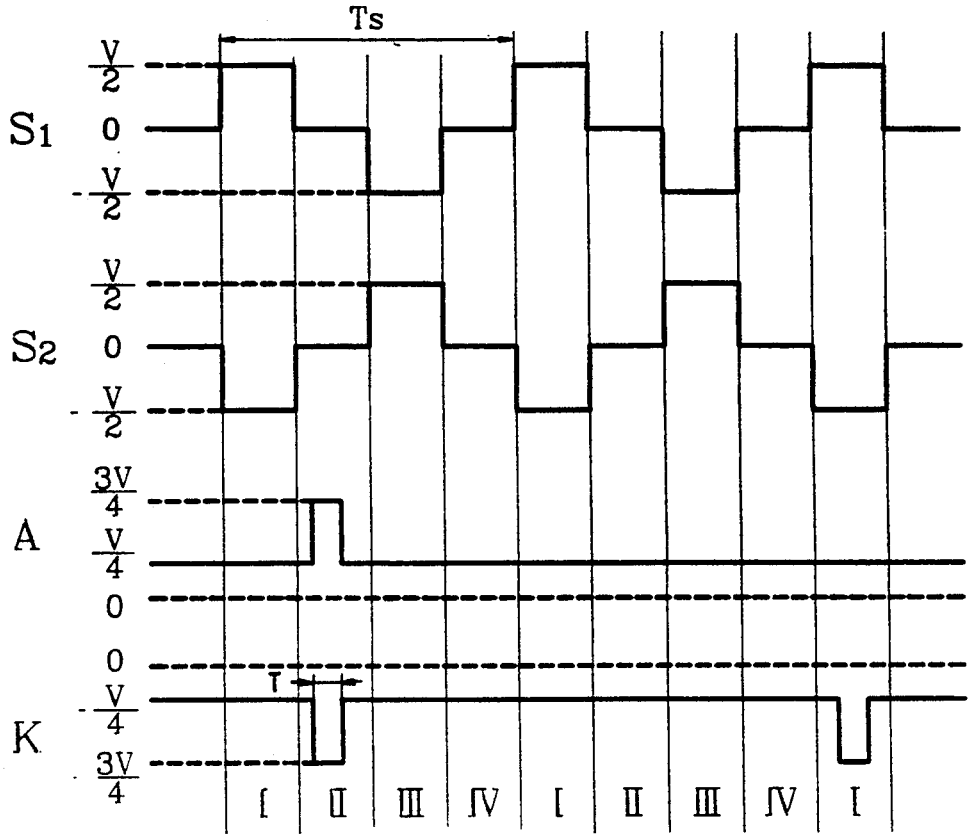
FIG. 3A shows one embodiment of a driving method of the plasma display panel according to the present invention.

FIG. 3A shows one embodiment of a driving method of the plasma display panel according to the present invention.

In FIG. 3A, a period Ts and amplitude V of the sustaining pulse are supplied to a discharging cell by the sustaining circuit. Here, sustaining electrode 14 is supplied with a pulse S1 which varies from zero volt to +V/2 volts, from +V/2 volts back to zero volt, and then from zero volt to −V/2 volts. A sustaining electrode 16 is supplied with a pulse S2 which varies from zero volt to −V/2 volts, from −V/2 volts back to zero volt, and then from zero volt to +V/2 volts. During an interval II wherein the pulse of both sustaining electrodes are at zero potential, a scanning pulse which has an amplitude of V/2 is supplied to the cathode, and a writing pulse which has an amplitude of V/2 is supplied to the anode. In addition, an erasing pulse is supplied during a period I after a predetermined time has elapsed. Here, the duration (T) of the pulse for erasing becomes approximately one tenth to one fifth the period of the writing pulse.

Figure 3B:
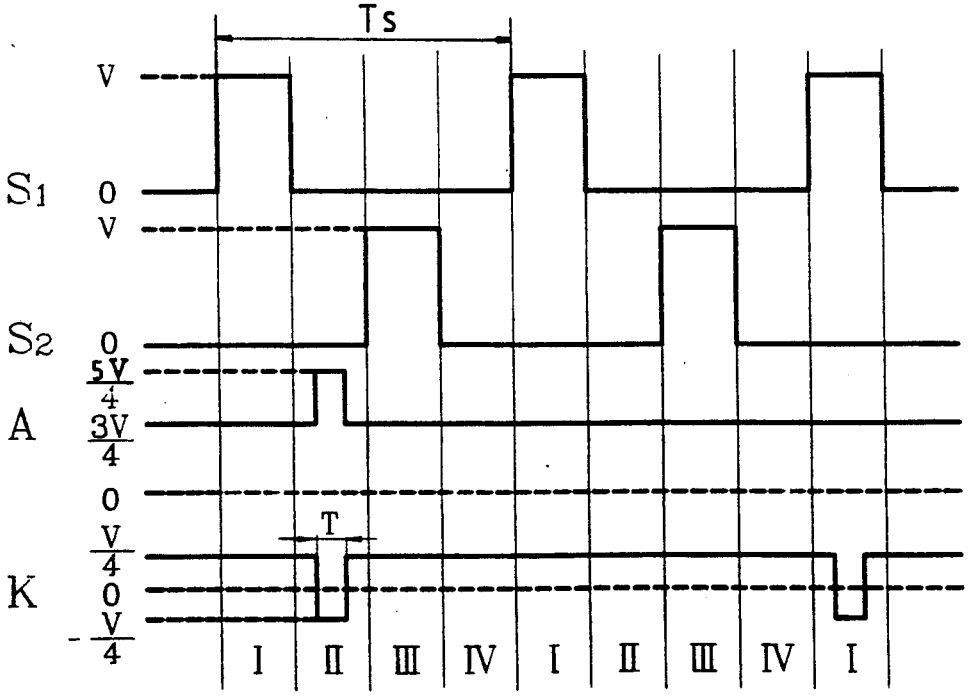
FIG. 3B shows another embodiment of a driving method of the plasma display panel according to the present invention.

FIG. 3B shows another embodiment of a driving method of a plasma display panel according to the present invention.

In FIG. 3B, a sustaining electrode 14 is supplied with a pulse S1 which varies from zero volt to +V volts, then from +V volts back to zero volt, and a sustaining electrode 16 is also supplied with a pulse which varies from zero volt to +V volts, then from +V volts to zero volt but with a delayed time as compared with pulse S1. The pulses supplied to the sustaining electrodes are pulses whose duration is "T," and whose amplitude is "V." During an interval II, if a scanning pulse is applied to the cathode, and a write pulse for writing data is applied to the anode, data is written in. The scanning pulse (K) is a pulse which varies from +V/4 volts to −V/4 volts, making its amplitude V/2 volts. The writing pulse (A) is a pulse which varies from +3 V/4 volts to +5 V/4 volts, making its amplitude also V/2 volts. The written data is erased by applying a pulse having an amplitude of V/2 volts during interval I. Here too, the duration (T) of the erasing pulse is approximately one tenth to one fifth the period of the write pulse for writing the data.

Based on the above-described structure and driving methods, the operation of the plasma display panel of the present invention will be described below. First, the method illustrated with reference to FIG. 3A is as follows.

During writing interval II, priming particles are created due to the potential difference between pulses supplied to the anodes and cathodes. In an interval III, due to the potential difference between a −V/2 volt pulse supplied to sustaining electrode 14, and a V/2 volt pulse supplied to sustaining electrode 16, the priming particles move from sustaining electrode 16 to sustaining electrode 14, thereby sustaining discharge. Here, an interval IV maintains the same states as interval III. In the following interval I, due to tile potential difference between a V/2 volt pulse supplied to sustaining electrode 14, and a −V/2 volt pulse supplied to sustaining electrode 16, the priming particles move from sustaining electrode 14 to sustaining electrode 16, thereby maintaining the discharging state. After repeating the above operations, when an erase pulse for erasing data is supplied during interval I, the priming particles disappear, thereby stopping discharge. The erasing is accomplished by eliminating the priming particles. Here, if a predetermined time required for forming the priming particles is shortened, the priming particles are eliminated without being created. Accordingly, the pulse duration of the erasing pulse is shortened.

Hereinafter, the driving method illustrated with reference to FIG. 3B will be described.

During writing interval II, priming particles are created by the potential difference between the pulses supplied to tile anodes and cathodes. In interval III, due to tile potential difference between a zero volt pulse supplied to sustaining electrode 14, and a pulse having a potential of 1V supplied to sustaining electrode 16, the priming particles move from sustaining electrode 16 to sustaining electrode 14, thereby maintaining the discharging state. In interval IV, the discharging state is maintained as in interval III. In the following interval I, due to the potential difference between a 1 V pulse supplied to sustaining electrode 14, and zero volt supplied to sustaining electrode 16, the priming particles move from sustaining electrode 14 to sustaining electrode 16, to sustain discharge. After repeating the above operations, when an erase pulse for erasing data is supplied during interval I, the priming particles disappear, thereby stopping the discharge.

As a result, since dielectric material is covered on the sustaining electrode in the present invention, not only is space charge utilized but also wall charge, simultaneously, thereby sustaining discharge. Therefore, stable memory operation becomes possible.

What is claimed is:

1. A plasma display panel comprising:

a first plate;

a second plate having an inner surface opposed to the first plate;

a gas disposed between the first and second plate;

stripe-like anodes and barrier ribs disposed on the first plate;

first sustaining electrodes disposed on the inner surface of the second plate for sustaining a discharge;

a dielectric material covering the first sustaining electrodes and isolating the first sustaining electrodes from the gas;

stripe-like cathodes disposed on the dielectric material as second sustaining electrodes; and a plurality of capacitors respectively connected to the stripe-like cathodes at respective common nodes.

2. A plasma display panel as claimed in claim 1, wherein said first sustaining electrodes are arranged as stripes in the same direction of said cathodes.

3. A plasma display panel as claimed in claim 1, wherein said first sustaining electrodes are arranged as stripes in the same direction of said anodes.

4. A plasma display panel as claimed in claim 1, wherein said first sustaining electrodes are arranged in one plane.

5. A driving method of a plasma display panel comprising: stripe-like anodes and barrier ribs formed on an upper face plate; first sustaining electrodes formed on the whole inner surface of a lower rear plate, and covered with a dielectric material; and stripe-like cathodes formed on said dielectric material and connected to the respective capacitors via a common node, thereby serving as second sustaining electrodes, wherein said first sustaining electrode is supplied with a pulse varying from ground potential to a first positive potential, from said first positive potential back to ground potential, and then from ground potential to a first negative potential;

said second sustaining electrode is supplied with a pulse varying from ground potential to said first negative potential, from said first negative potential back to ground potential, and then from ground potential to said first positive potential;

said anode is supplied with a writing pulse varying from a third positive potential to a fourth positive potential for data writing, when said pulses of said first and second sustaining electrodes are both at ground potential and said cathode is supplied with a negative scanning pulse varying from a third negative potential to a fourth negative potential; and said cathode is supplied with a negative erasing pulse having an amplitude equal to the difference between said third and fourth potentials, for erasing said written data after a predetermined time has elapsed.

6. A driving method of a plasma display panel as claimed in claim 5, wherein the duration of said erasing pulse is one tenth to one fifth the period of said writing pulse.

7. A driving method of a plasma display panel comprising: stripe-like anodes and barrier ribs formed on an upper face plate; first sustaining electrodes formed on the whole inner surface of a lower rear plate, and covered with a dielectric material; and stripe-like cathodes formed on said dielectric material and connected to the respective capacitors via a common node, thereby serving as second sustaining electrodes, wherein said first sustaining electrode is supplied with a pulse varying from ground potential to a first positive potential, then from said first positive potential to ground potential;

said second sustaining electrode is supplied with a pulse varying from ground potential to said first positive potential, then from said first positive potential to ground potential;

said anode is supplied with a writing pulse varying from a fourth positive potential to a fifth positive potential for data writing, when said pulses of said first and second sustaining electrodes are both at ground potential and said cathode is supplied with a negative scanning pulse varying from a third positive potential to a third negative potential; and said cathode is supplied with a negative erasing pulse having an amplitude equal to the difference between said third and fourth positive potentials for erasing said written data after a predetermined time has elapsed.

8. A driving method of a plasma display panel as claimed in claim 7, wherein the duration of said erasing pulse is one tenth to one fifth the period of said writing pulse.

9. The plasma display panel as claimed in claim 1 wherein the stripe-like cathodes partly cover the first sustaining electrodes.

* * * * *